United States Patent [19]

Campe

[11] Patent Number: 5,070,549

[45] Date of Patent: Dec. 10, 1991

[54] SHOWER CABINET

[75] Inventor: Joseph Campe, Rixensart, Belgium

[73] Assignee: Millburn Associates Limited, London, United Kingdom

[21] Appl. No.: 553,664

[22] Filed: Jul. 18, 1990

[51] Int. Cl.[5] ..... A47K 3/22

[52] U.S. Cl. ..... 4/596; 4/601; 4/612; 4/614

[58] Field of Search ..... 4/596, 601, 612, 613, 4/614, 663, 605, 597, 607, 524; 128/66, 365, 366, 368, 369, 402

[56] References Cited

U.S. PATENT DOCUMENTS 1,196,433 8/1916 Crum et al. ..... 4/524

FOREIGN PATENT DOCUMENTS 0348653 1/1990 European Pat. Off. ..... 4/614
3137406A1 4/1983 Fed. Rep. of Germany .
3738424 5/1989 Fed. Rep. of Germany ..... 4/612

*Primary Examiner*—Henry J. Recla
*Assistant Examiner*—Glenn T. Barrett
*Attorney, Agent, or Firm*—Fleit, Jacobson, Cohn, Price, Holman & Stern

[57] ABSTRACT

A shower cabinet including a shower base, a peripheral frame positioned along at least two contiguous sides of the shower base, and panels defining lateral walls and an access door; at least one water sprinkler connected to cold and hot water pipes through a mixing valve, the sprinkler and mixing valve being provided on an upright column housing the hot and cold water pipes, and a window on said column to operate the mixing valve, from the inside and from the outside of the cabinet.

7 Claims, 3 Drawing Sheets

SHOWER CABINET

BACKGROUND OF THE INVENTION

This invention refers to a shower cabinet comprising a sink forming the base for the shower cabinet, spaced apart uprights at corners at the sink for supporting lateral walls defining an access door, and an overhead sprinkler connected to hot and cold water supply by a water mixing valve.

In a traditional shower cabinet the sink, or shower base, is usually positioned against contiguous brick walls of the room in which the shower cabinet is installed, after which on the remaining sides of the shower base is erected a framework with panels defining side walls of the cabinet, at least one of which constitutes the access door.

In traditional shower cabinets all the internal accessories such as the water sprinkler, the mixing valve for hot and cold water and respective water supply pipes, must be suitably located in the brick walls before the shower cabinet is installed. As a result any later work, for example the replacement of the sprinkler or of the mixing unit, or any repairs to the water-supply pipes, necessitates breaking the brick walls or the ceramic tile surfacing, with the risk of damaging the shower base beneath or the glass walls of the cabinet.

The mixed water sprinkler, like other accessories inside the cabinet, once installed can no longer be removed or replaced without causing damages.

From German Patent Application 3 137 406 a shower cabinet is known comprising a frame, and side walls in which a water sprinkler is provided on a upright at one corner of the cabinet, facing the access door; therefore the sprinkler deliver the mixed water in a direction towards the door causing leaking out. Furthermore the upright is positioned in a corner of the shower base which is far from the door and near a brick wall of the building, preventing to centralize water control means and to operate the same from the outside of the cabinet.

Accordingly, an object of this invention is to provide a shower cabinet having a new and different structure compared with shower cabinets currently in use, by means of which it is possible to centralize the water-supply pipes, the various control means and other cabinet accessories, inside the shower cabinet.

Another object of this invention is to provide a shower cabinet, in which the mixed water sprinkler is adjustably mounted on the cabinet frame and is positioned so that the water jet is facing away from the access door of the cabinet.

A further object of this invention is to provide a shower cabinet in which the water mixing valve can be made accessible to open and to close both from the inside and from the outside of the cabinet.

In particular, according to this invention, the frame of the shower cabinet is provided at a corner with a hollow upright column in which are housed all the control devices for supply of the hot water, the cold water, and the mixed water, or other accessories, such as soap shelves, drawers, receptacle cavities possibly closed off by panels or similar means.

The central positioning of the pipes and of the water control device on the upright column also makes it possible to have on the outside of the shower cabinet, such as a display for checking of the temperature of the mixed water.

Alternatively, the pipe or pipes for the mixed water can be extended along an upper band on a side wall near the central column, so as to have one or more additional sprinklers fixedly or movably positioned along said band.

The use of a hollow central column offers therefore several advantages in that a sprinkler for the mixed water and the mixing valve may be suitably positioned allowing to control the mixed water temperature from the outside.

DESCRIPTION OF THE DRAWINGS

These and other characteristics of a shower cabinet according to this invention will be made more apparent from the description and drawings, in which.

DESCRIPTION OF THE INVENTION

Figure 1:
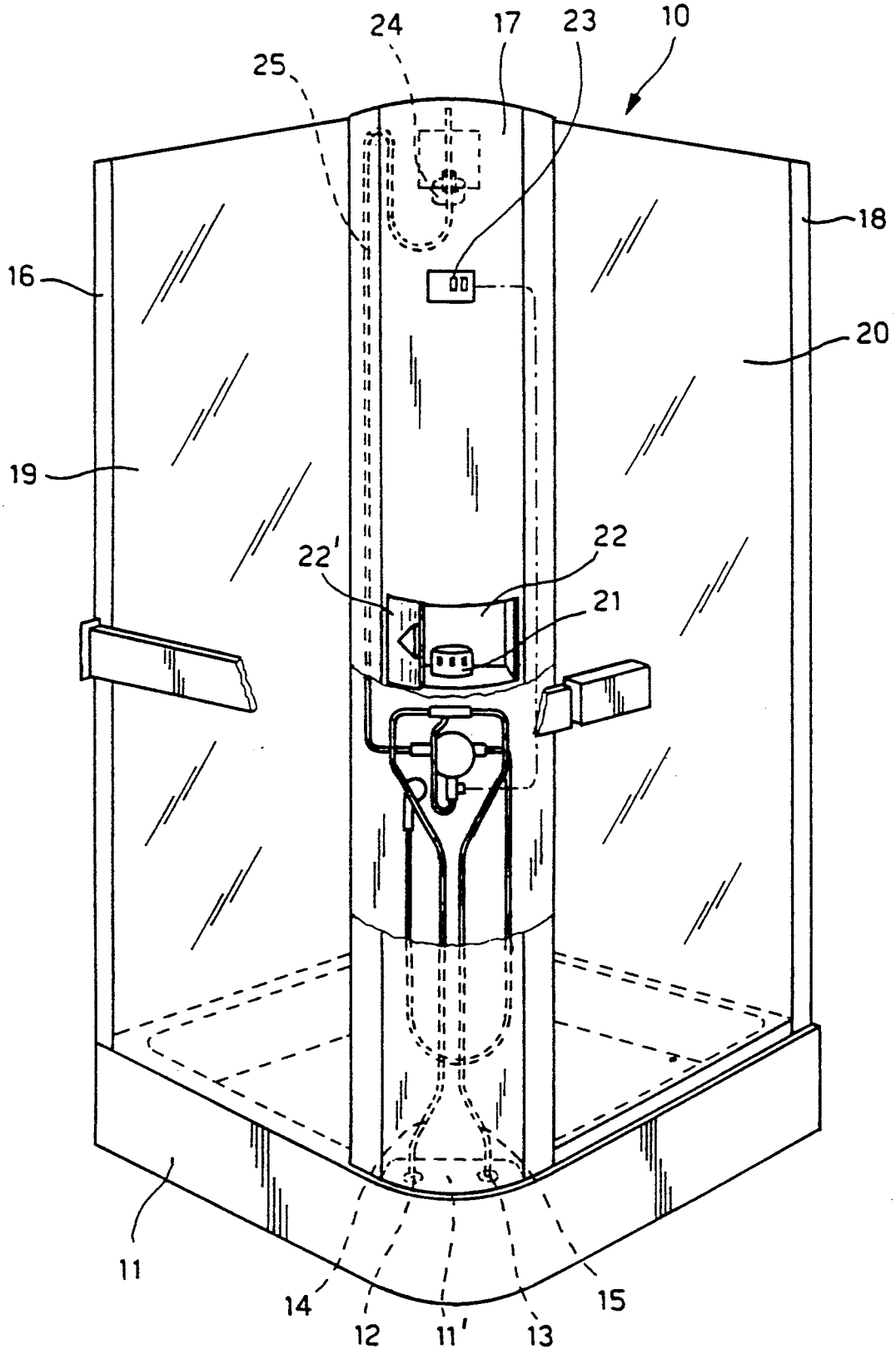
FIG. 1 is a perspective view from the outside of the cabinet.

As shown in FIG. 1, the shower cabinet 10 comprises a shower base or sink 11 having along its upper edge a flat supporting surface 11' at one corner, in which holes or openings 12 and 13 have been provided for the passage of the cold and hot water pipes 14, 15.

The shower cabinet also comprises a peripheral frame having uprights 16, 17 and 18 at the corners to support glasses or panels 19, 20 enclosing the shower cabinet on at least two sides and providing an access door 19. The two uprights 16 and 18 of the cabinet are fixed to the brick walls of a room by screws or other conventional fastening means.

The central upright 17 is in the form of an hollow column so as to house the cold and hot water pipes 14, 15 which are also in part located beneath the shower base 11 emerging from the above-mentioned holes 12 and 13.

The cold and hot water pipes 14 and 15 lead to a mixing valve 21 or to respective taps mounted in a cavity inside the central column 17, whose control knob or lever is accessible both from the inside and from the outside of the shower cabinet through a small window or aperture 22 in the column 27, closed by an hinged wing 22'.

Above the mixing unit 21 a digital or other type of display 23 may be provided for a thermostat that controls the temperature of the mixed water fed by the mixing unit 21 to at least one sprinkler 24, via a pipe 25 extending up inside the central column 17.

Figure 2:
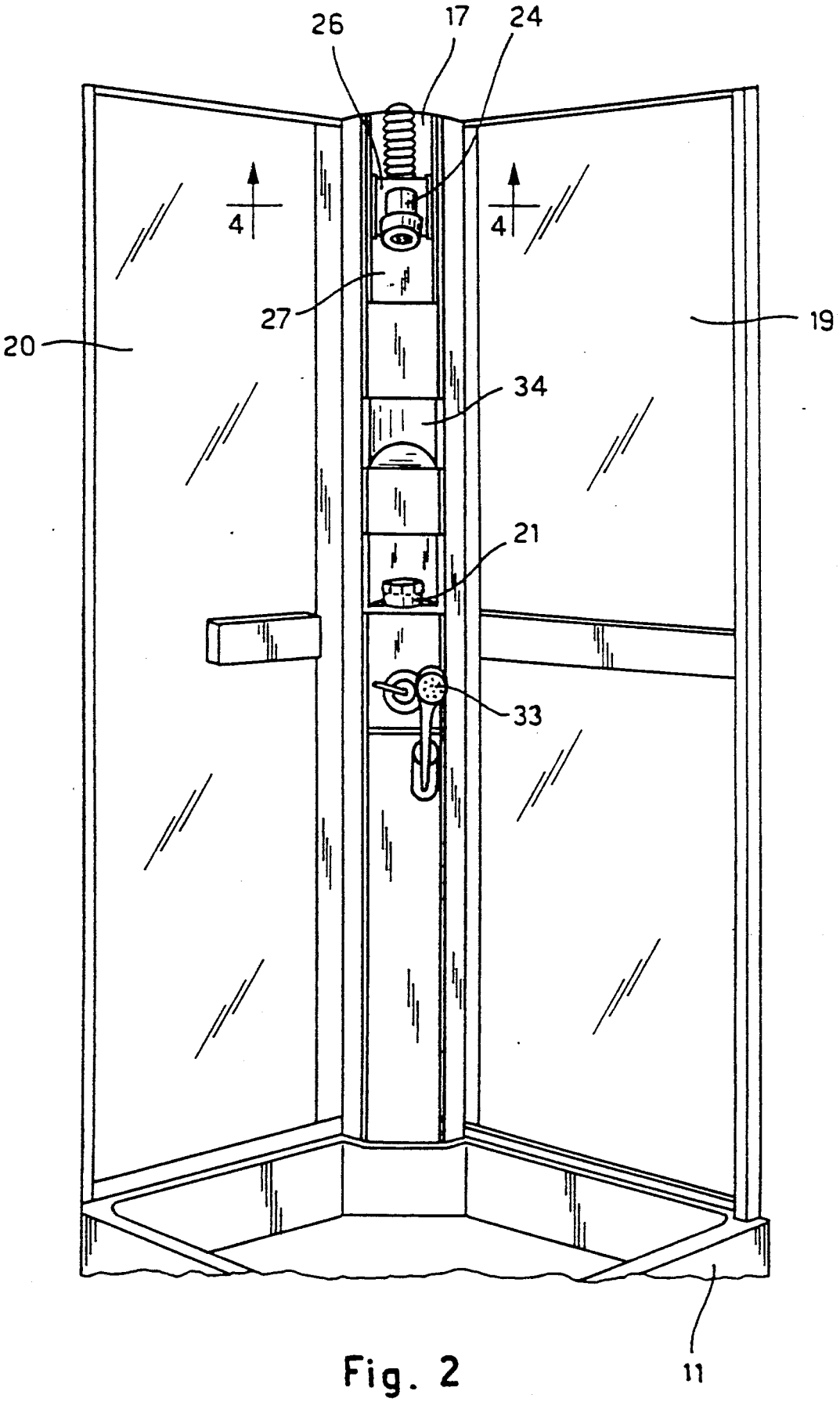
FIG. 2 is a perspective view from the inside.

As shown in FIG. 2, the sprinkler 24 is positioned in front of the central column 17 and being so oriented that the water jet is directed inwards to the shower cabinet and far from the inlet door 19; in this way the water jet does not directly strike the peripheral walls 19, 20 of the cabinet 10 so preventing possible water leakage from accidently seeping outside.

Figure 4:
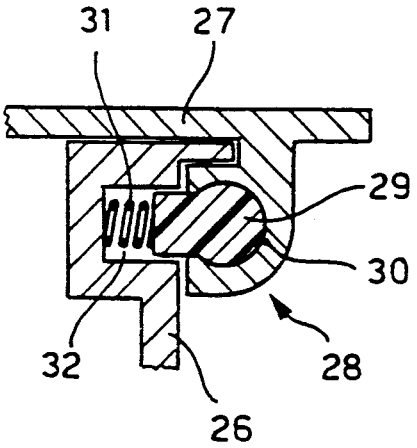
FIG. 4 is an enlarged sectional veiw according to line 4—4 of FIG. 2.

The sprinkler 24 is slidably and adjustably supported on the column 17 by a slide 26 movable along a guide 27 fastened to an inside panel of the column 17; elastically biased frictional means 28 (FIG. 4) are provided on both sides of the slide 26 to maintain a require position of the sprinkler. Said frictional means 28 comprises a pad member 29 running in a longitudinal channel 30 of guide 27, and biased by spring 31 in a seat 32 of the slider 26.

The central column 17 can be variously constructed or constituted according to specific needs. In particular FIG. 2 shown the use of a second sprinkler 33 connected to a hose, and a soap niche 34 or cavity.

Figure 3:
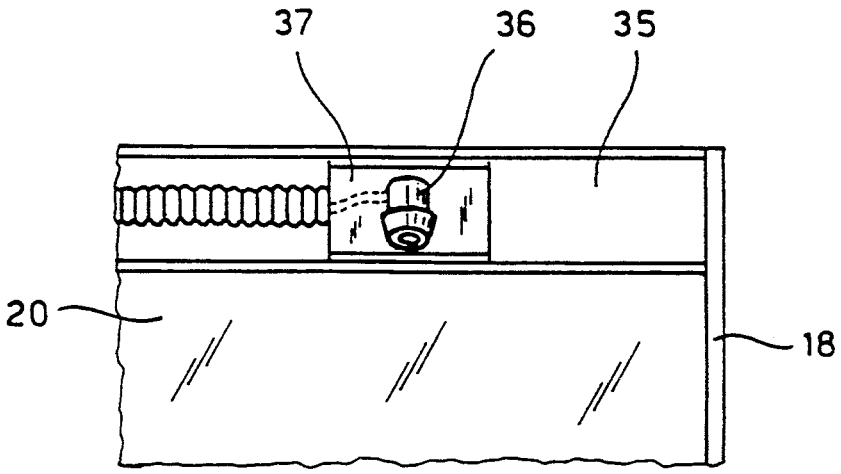
FIG. 3 is a view from the inside of an upper band on a lateral wall of the shower cabinet.

In the case in FIG. 3, unlike or in combination with the previous case, one side 20 of the cabinet 10 is provided with an upper band 35 provided with a sprinkler 36 that can be both fixed or slide on a support plate 37 in the same way of sprinkler 24.

In place of or as an alternative to the sprinkler 36, linear sprinkler may be provided in the form of a horizontally extending perforated tube, with the jets pointed downwards. The perforated tube and the flexible tube of the sprinkler 36, may be connected to a junction cock which enables one or the other sprinkler to be supplied.

From what has been said and shown in the appended drawings it will be accordingly understood that there is provided a shower cabinet structure of completely new design, forming a combination with a special shower base and an hollow column in a corner of the base sink that allows centralisation of all the controls, said column being equipped on the inside with all the accessories necessary for washing and allowing to control the mixing valve from the inside and the outside.

What is claimed is:

1. A shower cabinet comprising a sink forming a base of the cabinet, spaced apart uprights supported at corners of the sink, lateral walls including an access door, and an overhead water sprinkler connected to a hot and a cold water feeding pipes by a water mixing valve, in which one of said corner uprights is in the form of a hollow upright column member containing said water mixing valve, and the hot and cold water feeding pipes and supporting said sprinkler, and a small window with a door in said column at the vertical position of the mixing valve in said column to operate said water mixing valve from the inside and the outside of the cabinet.

2. Bathing cabinet according to claim 1 in which said sprinkler is directed away the access door, and in which a thermometer displays the temperature of the mixed water on the outside of said column on the exterior of the cabinet.

3. Bathing cabinet as claimed in claim 1, in which the upright column has inwardly opening receptacles.

4. Bathing cabinet as claimed in claim 1, in which the sprinkler is provided on support means slidably movable on said upright column, and frictional means of said support means maintains said sprinkler in an adjusted position.

5. Bathing cabinet as claimed in claim 1, in which the upright column supports a second sprinkler.

6. Bathing cabinet as claimed in claim 1, in which at least one of the cabinet walls comprises an upper band provided with at least one water sprinkler facing away from the door and directed towards the interior of the cabinet.

7. Bathing cabinet as claimed in claim 1, in which the shower base at one of its corners has a flat supporting surface for the upright column, said surface having holes for the passage of the hot and/or cold water pipes.

* * * * *